United States Patent [19]

Chance et al.

[11] Patent Number: 4,460,202

[45] Date of Patent: Jul. 17, 1984

[54] INTERMEDIATE WEIGHT DRILL STRING MEMBER

[76] Inventors: Glenn G. Chance, 5206 Cheena, Houston, Tex. 77096; William Kovensky, 5078 Whetstone Rd., Columbia, Md. 21044

[21] Appl. No.: 210,479

[22] Filed: Nov. 26, 1980

[51] Int. Cl.[3] ..... F16L 25/00

[52] U.S. Cl. ..... 285/333; 175/323; 308/4 A; 464/183; 285/286; 403/343

[58] Field of Search ..... 285/333, 334, 286; 403/343; 464/179, 183; 308/4 A; 175/323

[56] References Cited

U.S. PATENT DOCUMENTS

| | | | |
|---|---|---|---|
| 1,714,818 | 5/1929 | Reel | 285/333 X |
| 2,295,873 | 9/1942 | Stone | 308/4 A |
| 2,334,350 | 11/1943 | Neuhaus | 308/4 A |
| 2,999,552 | 9/1961 | Fox | 285/333 |
| 3,080,179 | 3/1963 | Huntsinger | 285/333 X |
| 3,125,173 | 3/1964 | Fox | 285/333 |
| 3,784,238 | 1/1974 | Chance et al. | 285/333 |

*Primary Examiner*—Dave W. Arola

[57] ABSTRACT

An improved intermediate weight member to be put in a drill string between the collars and the drill pipe which has a spiraled outer surface, and which is so configured as to provide a uniform bending moment of inertia over its length including the slip area.

10 Claims, 3 Drawing Figures

INTERMEDIATE WEIGHT DRILL STRING MEMBER

This invention pertains to an intermediate weight drill string member to be used between the drill pipe and the collars in a drill string used in the rotary system of drilling wells.

In conventional rotary drilling of wells, the drill bit is fastened to the lower end of a long string of pipe. The string is turned from the surface to cause the bit at the bottom to drill the hole. At the lower end, directly above the bit, there is a series of very thick walled pipes known as drill collars. Collars are much heavier than the drill pipe which makes up the bulk of the length of the string. The purpose of the drill collars is to put weight on the bit so that it will drill more efficiently. In general, in more difficult drilling situations, a greater number of drill collars will be used. The drill collars, since they weight down the bit, are in compression, but the remainder of the string, which is primarily drill pipe, extending from the upper end of the drill collars to the surface, is in tension. The relatively thin walled drill pipe does not operate well in compression and can even collapse.

The invention solves this problem by its ability to operate in tension or in compression in the drill string.

Another problem addressed by the invention, which occurs in deeper wells and especially in the increasingly used directional drilling situations, is that it is extremely difficult if not impossible to locate the transition zone between the area of compression where the drill collars should be and the area of tension where the drill pipes should be. Consequently, the lowest lengths of drill pipe are often exposed to compressive stresses, or even worse, to alternating compressive and tensile stresses, which can cause failure in the transition zone. Here again, the invention's ability to operate in tension or in compression solves the problem.

Typical conditions that could place the drill pipe in compression include uneven drilling feed which results in alternative tension and compression in the string as the bit drills the hole. That is, as the bit descends during each such cycle, the point of changing stress in the drill string changes and can move up and down between the drill collars and the drill pipe. The rotation of the entire drill string, as well as any turning or cocking of the drill string in the borehole, and especially the severe turning encountered when doing directional drilling, (drilling in a direction off vertical and to varying angles to the side), cause these forces to become severe enough to damage the drill string.

It has been heretofore known to use a member having an intermediate weight and wall thickness at this transition zone, see Chance U.S. Pat. No. 3,784,238 for example. By providing intermediate weight drill string members at the transition zone between the collars and the pipe, the entire drill string is less subject to failure since these transient forces will occur in this zone. Intermediate weight members resemble ordinary drill pipe, that is, they are formed with a slip and elevator area so that the tongs, elevators and other pipe handling equipment at the surface can handle the intermediate weight member just like ordinary drill pipe. Further, the intermediate weight member has some of the characteristics of collars in that it is almost as thick walled as collars, so as to provide extra strength in this troublesome zone in the drill string.

Drill collars use a different type of elevator than do drill pipe and the invention intermediate weight member. Some drill rigs do not have the elevators require to handle collars, and instead use various makeshifts. Interestingly, one such makeshift is known as a handling sub, which is a short member which simulates a drill pipe elevator so that a collar fitted with that sub can be handled like drill pipe. All drill rigs of course have the elevators needed to handle drill pipe. Thus, the invention's use of standard drill pipe elevators provides an advantage in the field.

An important improvement of the invention is the provision of a drill string member of the character described which has a substantially constant bending moment of inertia over its length including the slip and elevator area. This is accomplished by control of the depth of the spiral groove or grooves in the main body area. The grooving also provides the invention with the same advantages enjoyed by spiraled drill collars and spiraled drill pipe. Thus, in the present invention, as opposed to the stress inducing wear protectors of the prior U.S. Pat. No. 3,784,238, for example, there is provided a uniform bending moment of inertia over substantially the entire drill string member.

In addition, the spiral grooving provides numerous advantages, including to insure that no one area of the member will be differentially in contact with the borehole wall with respect to any other. Another advantage is that the spiral in effect screws the bit down onto the bottom of the hole. This is especially important in angled or directionally drilled wells since weight cannot be applied in the usual manner because of the bends and curves in the drill string.

The above and other advantages of the invention will be pointed out or will become evident in the following detailed description and claims, and in the accompanying drawing also forming a part of the disclosure, in which:

Figure 1:
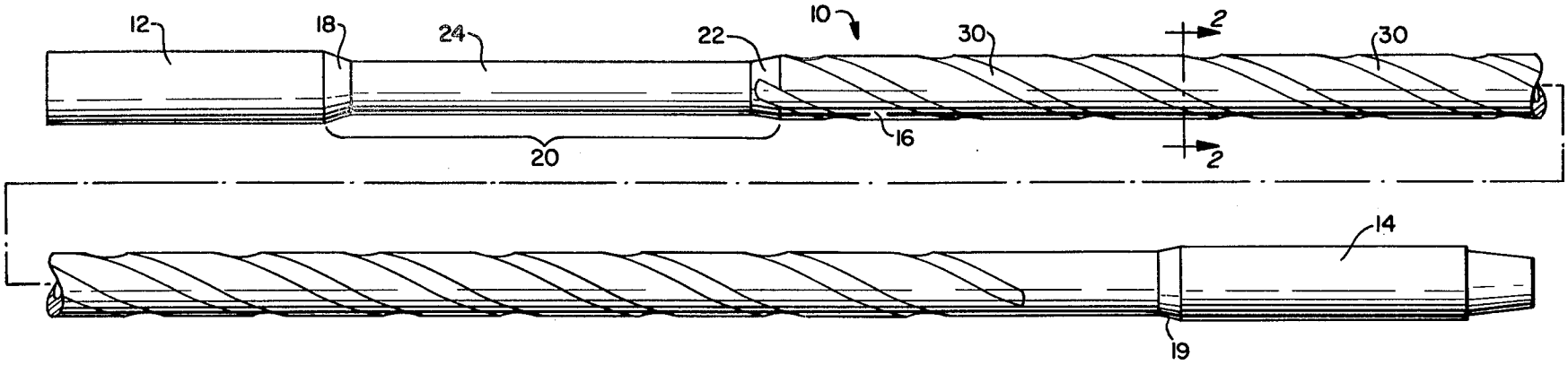
FIG. 1 is a elevational view of an intermediate weight drill string member embodying the invention.

In making up a drill string, the weight and rigidity of the intermediate drill string members of the invention will be selected with respect to the drill collars and the drill pipe going into that string such that the invention members will be intermediate in weight and rigidity to that of the weight and rigidity of the collars and pipe in that string. Thus, the term "intermediate weight drill string member" and the like as used in the claims and specification hereof shall be understood to mean such a medium weight and rigidity with respect to a particular drill string into which it is assembled. This is to be differentiated from having a weight intermediate than of the same nominal size collar or drill pipe. In fact, for some sizes, the invention member is very close to the weight of the same nominal size collar.

Referring now in detail to the drawings, intermediate weight drill string member 10 comprises a box tool joint end 12 and a pin tool joint end 14. These are standard tool joints used for drill strings. The male or pin end of one length is screwed into the female or box end of the next, and so on, to make up a drill string of any desired length. The invention member 10 is made by joining main body section 16 to the two tool joints 12 and 14 at zones 18 and 19 respectively. This can be accomplished by many different conventional techniques, usually welding, in these tapered sections 18 and 19 between the tool joints and the body. Inertial welding, added metal welding, friction welding, and the like can be used. Futher, it is also thought that body 16 together with tool joints 12 and 14 can be formed integrally in one piece, as by forging.

It is important to the invention that the body portion 16 is of substantially one diameter throughout its length, with the exception of the elevator and slip area 20 which extends from the tapered section 18 at the box end to the beginning of the spiral area as shown in the drawing. Area 20 is made by turning down the tube from which the body portion is formed from the tapered section 22 through reduced diameter cylindrical section 24 and merges into the tapered section 18 which joins the box to the body of the tube. Area 20 is used for the elevators to lift the member which fit on tapered section 18, and for the slips which are used to hold and turn the member, which grasp on cylinderical section 24 below the elevators. Thus, area 20 is known as the elevator and slip area, or by either name, in the field.

Between the sloped portion 22 and the pin end of the member 10 the body is spiraled with a plurality of spiral grooves 30, in the preferred form. It is thought that a single spiral groove 30 could be provided, but that is not thought to be better than a plurality of grooves, and it may generate other problems. A single groove however, is within the scope of the invention.

An improved feature of the invention is the use of spiral grooving over the entire length of the main body portion between the tool joints except for slip and elevator area 20. Spiraling drill collars is well known in the prior art, see for example Fox U.S. Pat. No. 2,999,552. Spiraling is also known to have been done on drill pipe but this is of dubious value since the wall of drill pipe is already thin.

However, spiraling as used in the invention produces all of the heretofore known advantages and in addition certain new advantages. The spiraling aids in preventing differential sticking. That is, it is possible with a smooth surfaced member that it will, having once touched the side of the borehole, be forced even tighter against that position because there is no way for the pressure in the mud to get between the member and the borehole. Via the spiral grooving, the pressure can come between the member and the borehole thus alleviating the differential sticking problem. The right hand spiral also helps increase bit weight via a screw effect, which is especially important in deviated, angled, directionally drilled, and other non-straight holes where heavy weight cannot be put on the bit from the surface in the usual manner.

Another advantage is that the grooving aids in removal of chips up the annulus between the drill string and the borehole. By having the spiral on the intermediate weight drill string member wound right handed, these channels will in effect "pump" the chips up the annulus and to the surface. A left handed spiral also could be provided, if required in some particular environment.

Perhaps most importantly, the spiraling allows the bending moment of inertia in the main body to be made to be equal to that in the slip and elevator area so that the invention member will have a uniform bending moment of inertia over substantially its entire length. The tool joints are standard for oil field tubular goods, and thus are not controllable. By adjusting the number of spirals, and their depth, the desired condition can be made to obtain, that is, the thicker main body spiral area will be equal in bending moment of inertia to that of the smaller diameter smooth walled slip area. This is especially important in directional drilling since the invention member will thus tend to form a smooth curve as it goes around a bend, thus not creating any undue areas of high stress. This should be contrasted with the prior art such as said prior U.S. Pat. No. 3,784,238, wherein the center enlarged portions are provided to prevent undue wear at the center of the pipe. Those center wear portions, or protectors as they are called, create two regions of high stress, one each at the two places where they meet the thinner wall main body portion. Such a member, when put around a curve, will create a series of straights, as opposed to one smooth curve as in the invention, with the junction at each end of each straight length being a point of high stress and a place where that member could fail.

We have also found that the pitch of the spirals is not important so long as that pitch is not sufficiently "tight" or so small so that the same spiral will occur twice in a single cross-sectional plane, i.e., will not appear as more than a chordal line notch in any cross-sectional plane. That is, since bending moment of inertia is dependent solely upon cross-sectional shape at a plane, so long as the pitch does not impinge upon any one plane more than once, or extend unduly across any such plane, then the pitch will have no effect. To illustrate this point, picture an ordinary screw spiral thread. A plane cut through such a spiral thread perpendicular to its axis will produce a cut-away over perhaps 120° to 180° on one side at the root of the thread, and will produce a full radius at the opposite side at the thread crest. In that case, the pitch would be sufficiently tight that it would impinge on bending moment of inertia. In the present invention the pitch is so long and gentle that minor changes in pitch do not impact on cross-sectional shape sufficiently to effect the bending moment of inertia.

Yet another improvement of the invention is the manner in which the spirals merge into area 20. The elevator area has a smaller diameter than the main body of the invention drill string member. It is changed with respect to the prior art in two ways, firstly, the transistion zone 18 is a truncated cone or tapered region and is at a particularly shallow angle so as to extend further along the axis of the member. Secondly, the spirals taper down through that region so that the bending moment of inertia equality is held through the transition zone and so that the smooth configuration in that zone precludes any undue stress concentrations.

Figure 2:
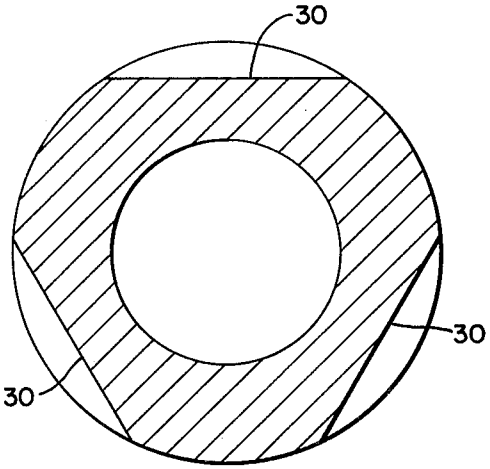
FIG. 2 is a cross-sectional view taken on line 2—2 thereof.

For the typical sizes with which the invention is used, it is thought that either three or four spiral grooves can be used. As developed above, spiral pitch is not critical so long as the resultant cross-sectional shape is similar to that shown in FIG. 2, i.e., the groove appears substantially as a chordal line in all planes perpendicular to the axis of the member through the spiral area. However, in general, the invention deals with grooves on the order of half inch deep over lengths on the order of 30 feet, the pitch is relatively gentle, and thus has no effect on bending moment of inertia.

As shown at the pin end of the drawing in FIG. 1, the spiraling stops slightly short of the tool joint 14. This is done because a short cylindrical section is needed to align the body and the tool joint for welding. It can be a very short section, on the order of 2 to 12 inches, and is expected to have a negligible effect on the performance of the invention drill string member.

Extensive mathematical analysis has been done to calculate the depth of groove for both three spirals and four spirals to make the bending moment of inertia in the spiraled area equal to that in the slip area so that substantially the entire member will have a uniform bending moment of inertia. The following Tables give many examples of depth of cut for different diameter slip areas in a given nominal size for three and four spiral grooves. Persons skilled in these arts can generate other tables, formulas, etc. to accomplish the same results.

Table I is based on an outside diameter in the grooved area of five and one half inches, and an inside diameter of three inches. In one example, it was desired to turn the elevator and slip area 20 to a diameter of five inches. Thus it can be seen that for three spiral grooves the depth of cut should be on the order or 0.62 inches, and for four spiral grooves the depth of cut of the spirals should be on the order of 0.50 inches.

TABLE I

| | 3 Grooves | | 4 Grooves | |
|---|---|---|---|---|
| Depth of Cut-Inches | Bending Moment of Inertia - Inches$^4$ | Equivalent Ungrooved O.D. | Bending Moment of Inertia - Inches$^4$ | Equivalent Ungrooved O.D. |
| 0.00 | 40.94 | 5.50 | 40.94 | 5.50 |
| 0.05 | 40.55 | 5.49 | 40.42 | 5.48 |
| 0.10 | 39.86 | 5.47 | 39.50 | 5.56 |
| 0.15 | 38.99 | 5.44 | 38.33 | 5.42 |
| 0.20 | 37.98 | 5.41 | 36.99 | 5.37 |
| 0.25 | 36.88 | 5.37 | 35.52 | 5.33 |
| 0.30 | 35.69 | 5.33 | 33.94 | 5.27 |
| 0.35 | 34.44 | 5.29 | 32.27 | 5.21 |
| 0.40 | 33.13 | 5.24 | 30.53 | 5.15 |
| 0.45 | 31.78 | 5.20 | 28.73 | 5.08 |
| 0.50 | 30.40 | 5.14 | 26.88 | 5.01 |
| 0.55 | 28.99 | 5.09 | 25.00 | 4.93 |
| 0.60 | 27.56 | 5.03 | 23.09 | 4.85 |
| 0.65 | 26.11 | 4.98 | 21.16 | 4.76 |
| 0.70 | 24.65 | 4.91 | 19.22 | 4.66 |
| 0.75 | 23.18 | 4.85 | 17.26 | 4.65 |

For Table II the outside diameter was five inches, and the inside diameter was $2\frac{7}{8}$ inches. The user can select a slip area diameter, and the Table gives the groove depth needed to hold a constant bending moment of inertia.

TABLE II

| | 3 Grooves | | 4 Grooves | |
|---|---|---|---|---|
| Depth of Cut-Inches | Bending Moment of Inertia - Inches$^4$ | Equivalent Ungrooved O.D. | Bending Moment of Inertia - Inches$^4$ | Equivalent Ungrooved O.D. |
| 0.00 | 27.61 | 5.00 | 27.61 | 5.00 |
| 0.05 | 27.30 | 4.99 | 27.20 | 4.98 |
| 0.10 | 26.76 | 4.96 | 26.47 | 4.95 |
| 0.15 | 26.07 | 4.94 | 25.56 | 4.91 |
| 0.20 | 25.29 | 4.90 | 24.52 | 4.87 |
| 0.25 | 24.43 | 4.87 | 23.37 | 4.82 |
| 0.30 | 23.51 | 4.82 | 22.15 | 4.76 |
| 0.35 | 22.54 | 4.78 | 20.86 | 4.70 |
| 0.40 | 21.54 | 4.73 | 19.51 | 4.63 |
| 0.45 | 20.50 | 4.68 | 18.13 | 4.56 |
| 0.50 | 19.44 | 4.63 | 16.72 | 4.48 |
| 0.55 | 18.37 | 4.57 | 15.29 | 4.40 |
| 0.60 | 17.28 | 4.51 | 13.83 | 4.31 |
| 0.65 | 16.18 | 4.45 | 12.37 | 4.21 |
| 0.70 | 15.08 | 4.38 | 10.90 | 4.11 |
| 0.75 | 13.97 | 4.32 | 9.43 | 3.99 |

Figure 3:
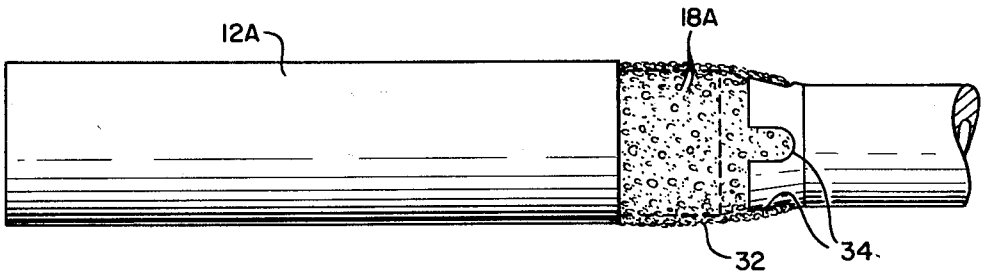
FIG. 3 is an enlarged view of an optional feature.

Referring now to FIG. 3, there is shown an enlarged view of a box end 12A including hard facing material 32 provided at the inner end of the box tool joint and extending in finger-like projections 34 onto portion 18A. FIG. 3 shows that the invention retains this optional feature of hard facing to protect the high wear region at the juncture between area 20 and the box end tool joint.

The slope of the conical portion 22 is very gentle, a slope on the order of 15° has been used. Heretofore, in the most similar prior art configurations, angles much steeper, on the order of 30° have been used. By providing this relatively shallow angle, this transistion zone has a longer axial length. In addition, the ends of the spiral grooves are caused to "feather" or decrease in thickness as they go through this transition zone. In this manner, a smooth transistion of stress from the larger diameter grooved body to the smaller diameter not grooved slip and elevator area is made, the bending moment of inertia is kept constant, and no undue stress concentration points are created.

As explained above, a drill string is made up of different nominal sizes of collars, intermediate members, and drill pipe. Some typical combinations are given in the following Table III (sizes are in inches). Their weights are shown in Table IV next following.

TABLE III

| String No | Collars | Invention Members | Drill Pipe |
|---|---|---|---|
| 1 | $4\frac{1}{8}$ | $2\frac{7}{8}$ | $2\frac{7}{8}$ |
| 2 | $4\frac{3}{4}$ | $3\frac{1}{2}$ | $3\frac{1}{2}$ |
| 3 | 6 | 4 | 4 |
| 4 | $6\frac{1}{4}$ | $4\frac{1}{2}$ | $4\frac{1}{2}$ |
| 5 | $6\frac{1}{2}$ | 5 | 5 |
| 6 | $7\frac{1}{4}$ | $5\frac{1}{2}$ | $5\frac{1}{2}$ |

As defined above, "intermediate weight" as used herein refers to weight of the invention member with respect to the collars and the drill pipe in a particular string. The following data illustrates some examples. Because of usage, the same sizes are not available for all three types of tubular goods, which does not matter since a string is made up of different sizes, see Table III. (Units are deleted as they are unneeded for the comparison; they have been equalized to the same weight units per unit length).

TABLE IV

| Nominal size (inches) | Collars | Invention Members | Drill Pipe |
|---|---|---|---|
| $2\frac{3}{8}$ | N.A. | 14.0 | 6.65 |
| $2\frac{7}{8}$ | N.A. | 20.0 | 10.4 |
| $3\frac{1}{2}$ | 28.5 | 26.0 | 13.3 |
| 4 | N.A. | 28.0 | 14.0 |
| $4\frac{1}{8}$ | 39.4 | N.A. | N.A. |
| $4\frac{1}{2}$ | N.A. | 42.0 | 16.6 |
| $4\frac{3}{4}$ | 49.6 | N.A. | N.A. |
| 5 | N.A. | 50.0 | 19.5 |
| $5\frac{1}{4}$ | 53.4 | N.A. | N.A |
| $5\frac{1}{2}$ | N.A. | 60.0 | 24.7 |
| $6\frac{1}{4}$ | 83.8 | N.A. | N.A. |
| $6\frac{1}{2}$ | 92.8 | N.A. | N.A. |
| $7\frac{1}{4}$ | 116.0 | N.A. | N.A. |

As to material, no additional teaching is necessary, as the invention is compatible with all grades of steel commonly used in oil field tubular goods.

The straights shown in FIG. 3 indicating the grooves 30 have been slightly exaggerated for clarity. In fact they may be smaller, and have a slight concavity. This curvature is so small that it has a zero effect on bending moment of inertia, and so slight that it cannot be seen by the naked eye. Thus, they are essentially chordal lines.

While the invention has been described in detail above, it is to be understood that this detailed description is by way of example only, and the protection granted is to be limited only within the spirit of the invention and the scope of the following claims.

We claim:

1. A drill string member to be interposed in a drill string between the collars at the bit end and the drill pipe at the upper end, said drill string member having a weight per unit length less than that of the collars and more than that of the drill pipe in said string thereby forming an intermediate weight member, said intermediate weight member including tool joint means at each end, said member having a slip and elevator area at one end of its body portion adjacent the tool joint means at said one end, the remaining main portion of said body between said slip and elevator area and said tool joint being formed with at least one spiral groove, said slip and elevator area having a diameter less than that of the spiral main body portion said tool joint means, and the depth and number of said at least one spiral groove being such that the bending moment of inertia through said spiral area is substantially equal to the bending moment of inertia in said slip and elevator area.

2. The combination of claim 1, wherein said main body portion is formed with three of said spiral grooves.

3. The combination of claim 1, wherein said main body portion is formed with four of said spiral grooves.

4. The combination of claim 1, the pitch of said at least one spiral groove being such that said groove will appear substantially as a chordal line in all planes perpendicular to the axis of said member through said spiral area.

5. The combination of claim 1, wherein said spiral groove area merges into said slip and elevator area at a relatively gentle sloped conical portion, and said at least one groove feathering through said conical portion, whereby the bending moment of inertia in said transistion zone between said slip and elevator area and said spiral area is substantially equal to the bending moment of inertia in said slip and elevator area and in said spiral area.

6. The combination of claim 5, wherein said sloped conical portion is at an angle of about 15°.

7. The combination of claim 1, and hard facing wear protecting material on the region of juncture between said slip and elevator area and the associated tool joint.

8. The combination of claim 1, wherein said tool joint means comprises separate tool joints welded onto the ends of said body portion.

9. The combination of claim 1, wherein said body together with said tool joint means are formed integrally together.

10. The combination of claim 1, wherein said at least one spiral groove is wound right handed, whereby said spiral groove tends to screw the drill bit at the lower end of the string down into the borehole.

* * * * *